US009188919B2

(12) United States Patent
Iwata et al.

(10) Patent No.: US 9,188,919 B2
(45) Date of Patent: Nov. 17, 2015

(54) FIXING DEVICE PROVIDED WITH ROTATING MEMBER HAVING CONCAVE SHAPE

(71) Applicant: Brother Kogyo Kabushiki Kaisha, Nagoya-shi, Aichi-ken (JP)

(72) Inventors: Naoyuki Iwata, Kakamigahara (JP); Yusuke Murodate, Nagoya (JP); Akihiro Kobayashi, Inazawa (JP); Tomoaki Hazeyama, Yokkaichi (JP); Yasuhiro Maruyama, Kasugai (JP); Yuji Nishigaki, Hashima (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/227,016

(22) Filed: Mar. 27, 2014

(65) Prior Publication Data

US 2014/0294463 A1 Oct. 2, 2014

(30) Foreign Application Priority Data

Mar. 29, 2013 (JP) ..... 2013-074354

(51) Int. Cl.
*G03G 15/20* (2006.01)

(52) U.S. Cl.
CPC .... *G03G 15/2053* (2013.01); *G03G 2215/2035* (2013.01)

(58) Field of Classification Search
CPC ..... G03G 15/2053
USPC ..... 399/329
See application file for complete search history.

(56) References Cited

U.S. PATENT DOCUMENTS

| | | | |
|---|---|---|---|
| 5,091,752 | A | 2/1992 | Okada |
| 6,775,509 | B2 | 8/2004 | Shida et al. |
| 7,177,579 | B2 | 2/2007 | Uchida et al. |
| 2003/0156866 | A1 | 8/2003 | Shida et al. |

(Continued)

FOREIGN PATENT DOCUMENTS

| | | | |
|---|---|---|---|
| JP | H03-241376 | A | 10/1991 |
| JP | H05-88571 | A | 4/1993 |
| JP | 2003-228246 | A | 8/2003 |
| JP | 2005-181989 | A | 7/2005 |
| JP | 3817482 | B2 | 9/2006 |

OTHER PUBLICATIONS

Co-pending U.S. Appl. No. 14/227,011, filed Mar. 27, 2014.

(Continued)

*Primary Examiner* — Quana M Grainger
(74) *Attorney, Agent, or Firm* — Banner & Witcoff, Ltd.

(57) ABSTRACT

The present invention provides a fixing device that may include a nip member, a rotating body and an endless belt. The endless belt may be in sliding contact with the nip member. The rotating body may constitute a nip region. The nip region may define a first, second and third imaginary planes. The first imaginary plane may be perpendicular to the sliding direction. The second imaginary plane may be perpendicular to the axial direction of the rotating body and may contain a first end portion of the nip region. The third imaginary plane may contain a second end portion of the nip region. The first surface may be a convex shape in a first cross-section along the first imaginary plane, and may be concave shape concaved in a direction opposite to the rotating body in second and third cross-sections along the second and third imaginary planes.

27 Claims, 6 Drawing Sheets

(56) References Cited

U.S. PATENT DOCUMENTS

| | | | | |
|---|---|---|---|---|
| 2005/0123329 | A1 | 6/2005 | Uchida et al. | |
| 2008/0124146 | A1* | 5/2008 | Bae et al. | 399/329 |

OTHER PUBLICATIONS

Co-pending U.S. Appl. No. 14/227,025, filed Mar. 27, 2014.
Co-pending U.S. Appl. No. 14/227,040, filed Mar. 27, 2014.

* cited by examiner

FIXING DEVICE PROVIDED WITH ROTATING MEMBER HAVING CONCAVE SHAPE

CROSS REFERENCE TO RELATED APPLICATION

This application claims priority from Japanese Patent Application No. 2013-074354 filed Mar. 29, 2013. The entire content of the priority application is incorporated herein by reference.

TECHNICAL FIELD

The present invention relates to a fixing device that thermally fixes a transferred developing agent image to a sheet.

BACKGROUND

Japanese Patent No.3817482 discloses a fixing device that includes an endless belt, a nip member disposed at an internal space of the endless belt, and a pressure roller that opposes the nip member so as to interpose the endless belt between the pressure roller and the nip member. Specifically, a surface of the nip member that is in contact with the endless belt is subjected to machining to have a convex surface in contact with the endless belt and having a central portion and end portions in an axial direction of the endless belt. The central portion has a protruding amount protruding toward the pressure roller greater than that of the end portions. In this way, wrinkling of recording sheets can be prevented.

SUMMARY

With the conventional technology, a wider nip region between the endless belt and the pressure roller is preferable at end portions in an axial direction of the pressure roller. However, when the pressure applied between the endless belt and the pressure roller is increased in order to make the nip region wider at the end portions, a motor used to rotate the pressure roller needs to deal with a larger load.

In view of the foregoing, it is an object of the present invention to provide a fixing device capable of increasing the width of the nip region at the end portions while the load on the motor used to rotate the pressure roller (rotating body) is moderate.

In order to attain the above and other objects, the present invention provides a fixing device that may include a nip member, a rotating body and an endless belt. The nip member may have a first surface and a second surface opposite to the first surface. The endless belt may have an inner peripheral surface and an outer peripheral surface. The inner peripheral surface may be configured to be in sliding contact with the first surface in a sliding direction. The rotating body may be configured to nip the endless belt in cooperation with the nip member, and may be configured to constitute a nip region between the endless belt and the rotating body. The rotating body may have an axis defining an axial direction. The nip region may define a first imaginary plane, a second imaginary plane, and a third imaginary plane. The first imaginary plane may be perpendicular to the sliding direction and may contain a center of the nip region in the sliding direction. The second imaginary plane may be perpendicular to the axial direction and may contain a first end portion of the nip region in the axial direction. The third imaginary plane may be perpendicular to the axial direction and may contain a second end portion of the nip region opposite to the first end portion in the axial direction. The first surface may be a convex shape protruding toward the rotating body in a first cross-section taken along the first imaginary plane, and may be concave shape concaved in a direction opposite to the rotating body in a second cross-section and a third cross-section taken along the second imaginary plane and the third imaginary plane.

The present invention further provides a fixing device that may include a nip member, a rotating body and an endless belt. The nip member may have a first surface and a second surface opposite to the first surface. The endless belt may have an inner peripheral surface and an outer peripheral surface. The inner peripheral surface may be configured to be in sliding contact with the first surface in a sliding direction. The rotating body may be configured to nip the endless belt in cooperation with the nip member, and may be configured to constitute a nip region between the endless belt and the rotating body. The rotating body may have an axis defining an axial direction. The nip region may define a first imaginary plane, and a second imaginary plane. The first imaginary plane may be perpendicular to the sliding direction and may contain a center of the nip region in the sliding direction. The second imaginary plane may be perpendicular to the axial direction and may contain a first end portion of the nip region in the axial direction. The first surface may be a convex shape protruding toward the rotating body in a first cross-section taken along the first imaginary plane, and may be concave shape concaved in a direction opposite to the rotating body in a second cross-section taken along the second imaginary plane.

DETAILED DESCRIPTION

A general structure of a laser printer as an image forming device according to one embodiment of the present invention will be described with reference to FIG.

Figure 1:
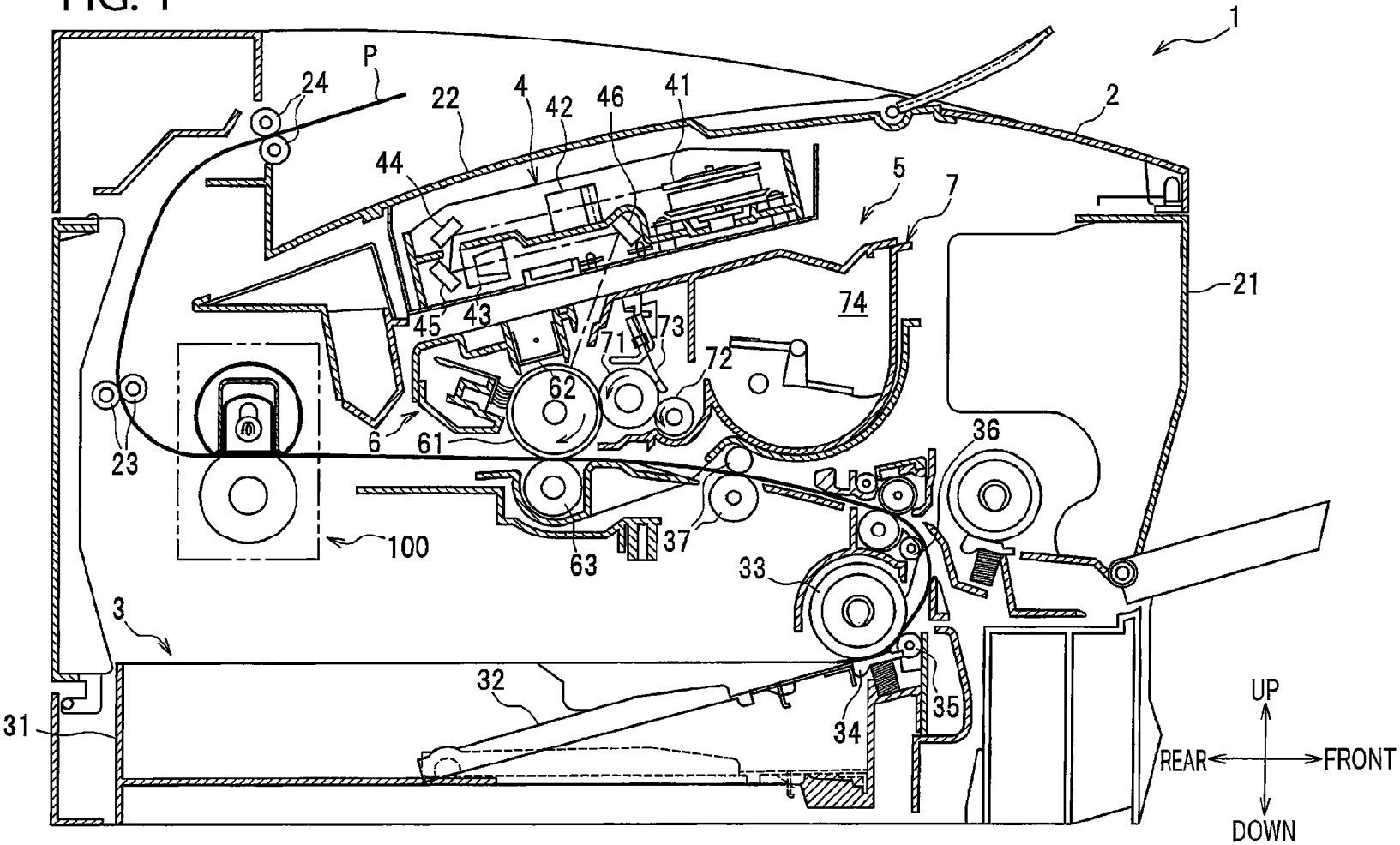
FIG. 1 is a schematic cross sectional view showing a structure of a laser printer having a fixing device according to one embodiment of the present invention.

1. A laser printer 1 shown in FIG. 1 is provided with a fixing device 100 according to the embodiment of the present invention. A detailed structure of the fixing device 100 will be described later while referring to FIGS. 2 to 4B.

<General Structure of Laser Printer>

As shown in FIG. 1, the laser printer 1 includes a main frame 2. Within the main frame 2, a sheet supply unit 3 for supplying a sheet P, an exposure unit 4, a process cartridge 5 for transferring a toner image (developing agent image) on the sheet P, and the fixing device 100 for thermally fixing the toner image onto the sheet P are provided.

Throughout the specification, the terms "above", "below", "right", "left", "front", "rear" will be used assuming that the laser printer 1 is disposed in an orientation in which it is intended to be used. More specifically, in FIG. 1, a left side and a right side of the figure are a rear side and a front side of the printer, respectively.

The sheet supply unit 3 is disposed at a lower portion of the main frame 2. The sheet supply unit 3 includes a sheet supply tray 31 for accommodating the sheet P, a lifter plate 32 for lifting up a front side of the sheet P, a sheet supply roller 33, a sheet supply pad 34, paper dust removing rollers 35 and 36, and registration rollers 37. Each sheet P accommodated in the sheet supply tray 31 is directed upward to the sheet supply roller 33 by the lifter plate 32, separated by the sheet supply roller 33 and the sheet supply pad 34, and conveyed toward the process cartridge 5 passing through the paper dust removing rollers 35 and 36, and the registration rollers 37.

The exposure unit 4 is disposed at an upper portion of the main frame 2. The exposure unit 4 includes a laser emission unit (not shown), a polygon mirror 41, lenses 42 and 43, and reflection mirrors 44, 45 and 46. In the exposure unit 4, the laser emission unit is adapted to project a laser beam based on image data so that the laser beam is deflected by or passes through the polygon mirror 41, the lens 42, the reflection mirrors 44 and 45, the lens 43, and the reflection mirror 46 in this order. A surface of a photosensitive drum 61 is subjected to high speed scan of the laser beam.

The process cartridge 5 is disposed below the exposure unit 4. The process cartridge 5 is detachable or attachable relative to the main frame 2 through a front opening defined by the front cover 21 at an open position. The process cartridge 5 includes a drum unit 6 and a developing unit 7.

The drum unit 6 includes the photosensitive drum 61, a charger 62, and a transfer roller 63. The developing unit 7 is detachably mounted to the drum unit 6. The developing unit 7 includes a developing roller 71, a toner supply roller 72, a doctor blade 73 for regulating toner thickness, and a toner accommodating portion 74 in which toner is accommodated.

In the process cartridge 5, after the surface of the photosensitive drum 61 has been uniformly charged by the charger 62, the surface is subjected to high speed scan of the laser beam from the exposure unit 4. An electrostatic latent image based on the image data is thereby formed on the surface of the photosensitive drum 61. The toner accommodated in the toner accommodating portion 74 is supplied to the developing roller 71 via the toner supply roller 72. The toner is conveyed between the developing roller 71 and the doctor blade 73 so as to be deposited on the developing roller 71 as a thin layer having a uniform thickness.

The toner deposited on the developing roller 71 is supplied to the electrostatic latent image formed on the photosensitive drum 61. Hence, a visible toner image corresponding to the electrostatic latent image is formed on the photosensitive drum 61. Then, the sheet P is conveyed between the photosensitive drum 61 and the transfer roller 63, so that the toner image formed on the photosensitive drum 61 is transferred onto the sheet P.

The fixing device 100 is disposed rearward of the process cartridge 5. The toner image (toner) transferred onto the sheet P is thermally fixed on the sheet P while the sheet P passes through the fixing device 100. The sheet P on which the toner image is thermally fixed is conveyed by conveying rollers 23 and 24 so as to be discharged on a discharge tray 22.

<Detailed Structure of Fixing Device>

Figure 2:
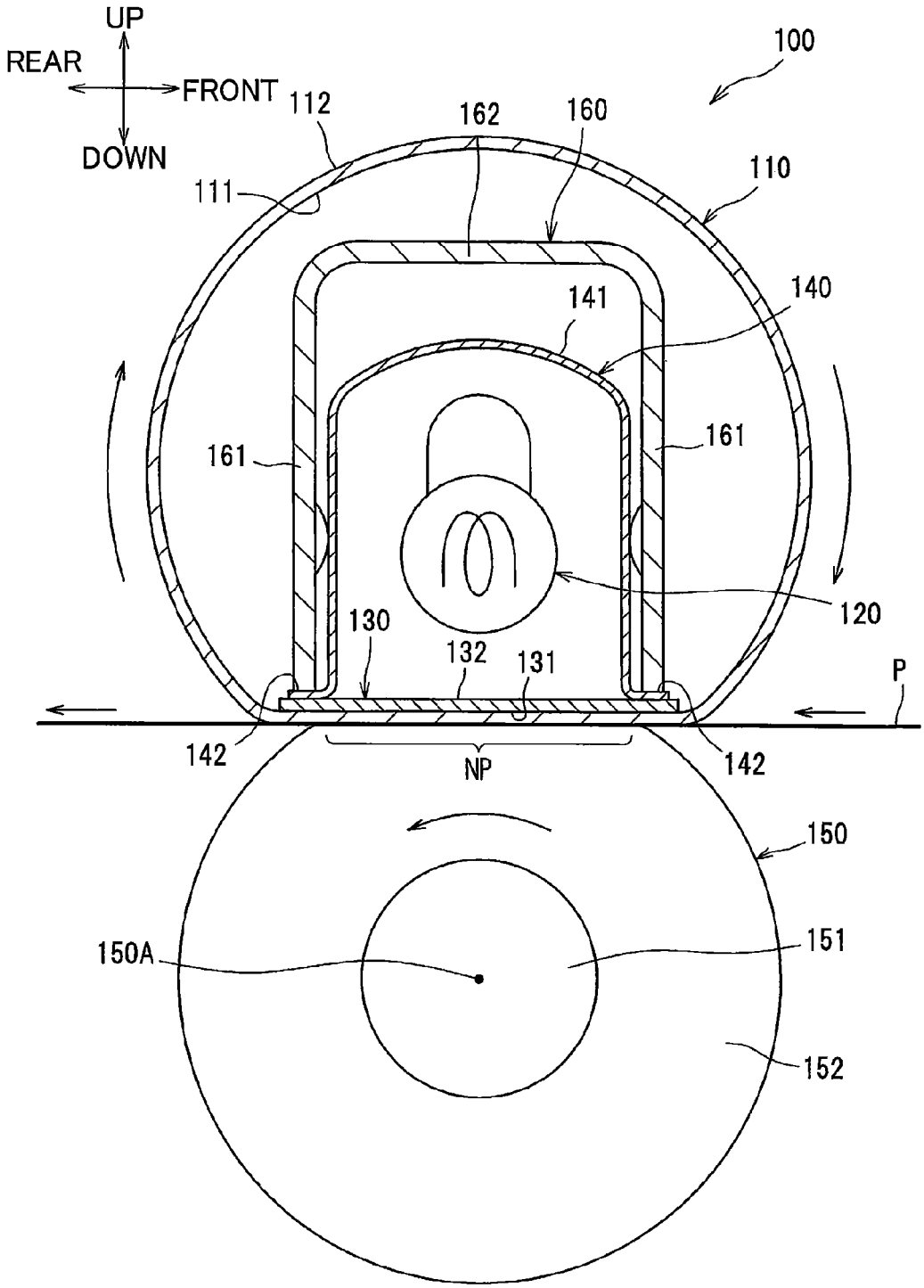
FIG. 2 is a cross sectional view of the fixing device.
Figure 3:
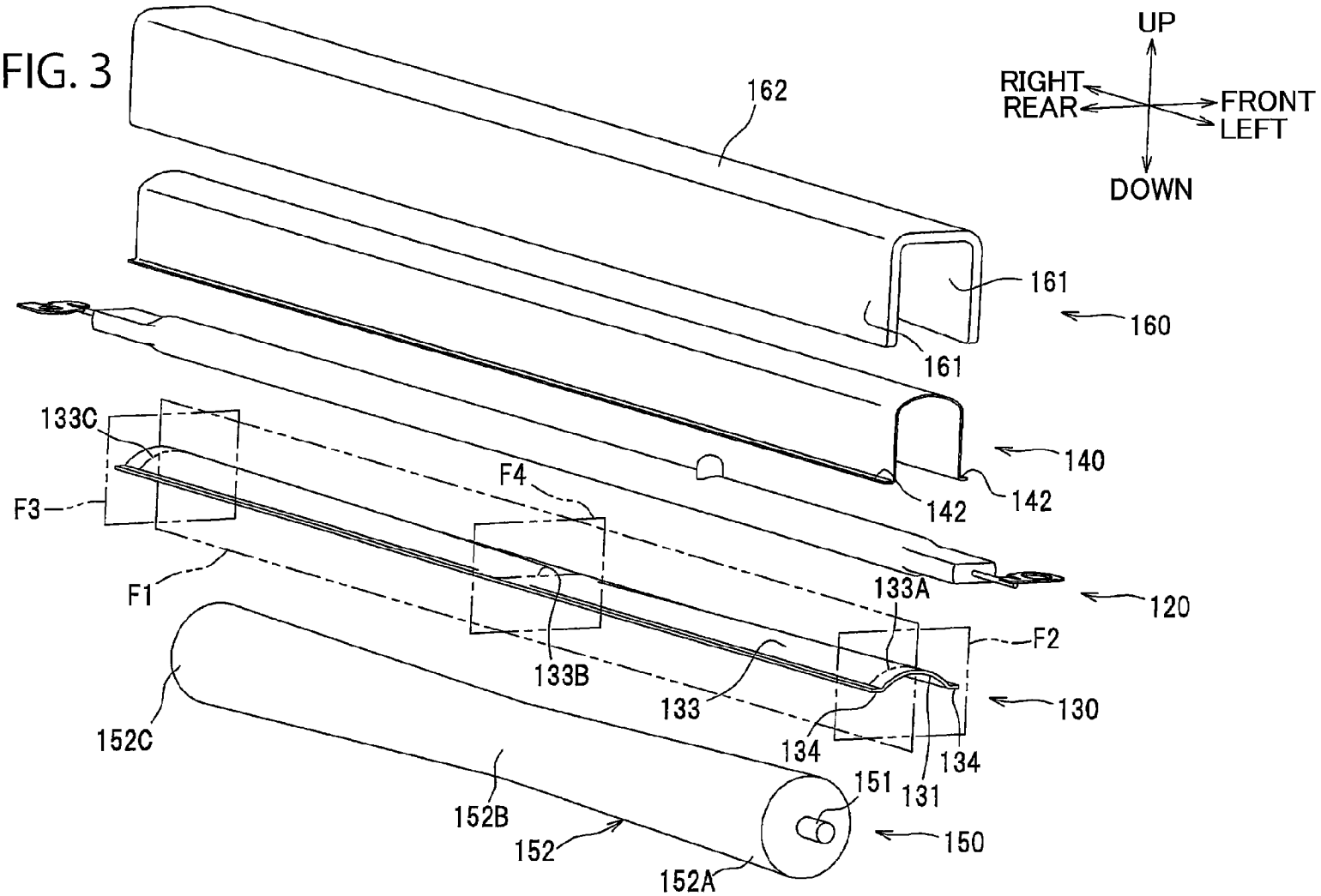
FIG. 3 is an exploded perspective view showing a halogen lamp, a nip plate, a reflection plate, a pressure roller, and a stay.

As shown in FIGS. 2 and 3, the fixing device 100 includes a fusing belt 110, a halogen lamp 120, a nip plate 130, a reflection plate 140, a pressure roller 150, and a stay 160. In FIG. 3, for the sake of convenience a length of the pressure roller 150 in the leftward/rightward direction is shown as being shorter than that of the nip plate 130, but in actuality the length of the pressure roller 150 in the leftward/rightward direction is approximately the same as that of the nip plate 130. (See FIG. 4B.)

The fusing belt 110 is a heat-resistant and flexible endless belt. The fusing belt 110 has a metallic tube made from stainless steel, and a fluorocarbon resin layer coated thereover. The fusing belt 110 has an inner peripheral surface 111 in sliding contact with the nip plate 130, and an outer peripheral surface 112 in sliding contact with the pressure roller 150.

The inner peripheral surface 111 is in sliding contact with a lower surface 131 (first surface) of the nip plate 130 and runs rearward relative to the nip plate 130. Here, the sliding direction of the inner peripheral surface 111 relative to the nip plate 130 refers to an average direction in which the inner peripheral surface 111 is in sliding contact with any points of the lower surface 131 of the nip plate 130 in the frontward/rearward direction. In the depicted embodiment, the sliding contact direction refers to a direction extending in the frontward/rearward direction in FIG. 2. In other words, the sliding contact direction refers to a direction that extends from an upstream end to a downstream end of a nip region NP relative to a rotation direction of the pressure roller 150.

As a modification to the fusing belt 110, a rubber layer can be provided between the metallic tube and the fluorocarbon resin layer.

The halogen lamp 120 is a heating element that emits radiant heat which heats the nip plate 130 and the fusing belt 110, and thereby heats the toner on the sheet P. The halogen lamp 120 is disposed at inside the fusing belt 110, and opposes an upper surface 132 (second surface) of the nip plate 130 at a prescribed distance therefrom. In this way, heat from the halogen lamp 120 can be substantially uniformly transferred to the upper surface 132 and the lower surface 131 of the nip plate 130. In addition, the halogen lamp 120 heats the fusing belt 110 indirectly through the nip plate 130.

The nip plate 130 is an elongated metallic plate extending in the leftward/rightward direction. The nip plate 130 has the lower surface 131 and the upper surface 132 positioned opposite to the lower surface 131. The lower surface 131 is in sliding contact with the inner peripheral surface 111 of the tubular fusing belt 110. The upper surface 132 is located at an opposite side of the nip plate 130 from the lower surface 131. The lower surface 131 is formed so as to run parallel to the upper surface 132. In this way, heat capacity of the nip plate 130 can be made substantially uniform, and thus fixing performance can be improved.

The lower surface 131 of the nip plate 130 can be coated with a film made from a nonmetallic oxide film or a fluororesin coating. In addition, the nip plate 130 is adapted to transfer the radiant heat received from the halogen lamp 120 and onto the toner on the sheet P through the fusing belt 110.

This nip plate 130 is formed into a planar shape and is made from a metal, for example, aluminum, so as to have a thermal conductivity higher than that of a stay 160 made from a steel (described later). This nip plate 130 has a thickness permitting bending deformation thereof. The thickness of the nip plate 130 can be ranging from 0.1 to 3.0 mm, or 0.3 to 2.0 mm, or 0.1 to 1.0 mm. The detailed structure of the nip plate 130 is described later.

The reflection plate 140 is adapted to reflect radiant heat from the halogen lamp 120 toward the nip plate 130. As shown in FIG. 2, the reflection plate 140 is positioned within the fusing belt 110 and surrounds the halogen lamp 120, with a predetermined distance therefrom. Thus, radiant heat from the halogen lamp 120 can be efficiently concentrated onto the nip plate 130 to promptly heat the nip plate 130 and the fusing belt 110.

The reflection plate 140 is configured into substantially U-shape in cross-section and is made from a material such as aluminum having high reflection ratio for infrared rays or far infrared rays. The reflection plate 140 has a substantially U-shaped reflection portion 141 and a flange portion 142 extending outward from each end portion of the reflection portion 141 in the frontward/rearward direction. A mirror surface finishing is applicable on the surface of the aluminum reflection plate 140 for specular reflection in order to enhance heat reflection ratio.

The pressure roller 150 is an elastically deformable member. The pressure roller 150 is disposed downward of the nip plate 130 to vertically oppose the outer peripheral surface 112 of the fusing belt 110. The pressure roller 150 defines a central axis 150A extending in the leftward/rightward direction, and is rotatable about this central axis 150A. The pressure roller 150 is configured to provide a nip region NP in cooperation with the fusing belt 110, when the fusing belt 110 is nipped between the pressure roller 150 and the nip plate 130 while the pressure roller 150 is in an elastically deformed state. Here, the nip region NP is formed so as to be longer in the leftward/rightward direction than a sheet width BB (described later), and is formed so as to protrude further in the leftward/rightward direction than respective left and right edges of the sheet P. (See FIG. 4B.)

The pressure roller 150 has a metallic shaft 151 and a rubber layer 152 coated thereover. The shaft 151 is formed into a linear shape, with a radius that is substantially constant across the leftward/rightward direction.

The rubber layer 152 has a first end portion 152A, a central portion 152B, and a second end portion 152C, in the axial direction (leftward/rightward direction) of the pressure roller 150. The rubber layer 152 is formed into a concave shape such that respective diameters of the end portions 152A and 152C are larger than that of the central portion 152B regardless of whether or not fixing operation is performed, i.e. regardless of heat application. In other words, the rubber layer 152 is formed such that the end portions 152A and 152C are thicker than the central portion 152B.

The pressure roller 150 is rotationally driven upon transmission of a drive force from a drive motor (not shown) disposed in the main frame 2. By the rotation of the pressure roller 150, the fusing belt 110 is circularly driven because of a friction force generated therebetween or between the sheet S and the fusing belt 110. A toner image (toner) transferred onto the sheet P can be thermally fixed thereto by heat and pressure during passage of the sheet P at the nip region NP between the pressure roller 150 and the heated fusing belt 110.

The stay 160 is adapted to support the end portions of the nip plate 130 through the flange portion 142 for maintaining rigidity of the nip plate 130. The stay 160 is positioned on the opposite side of the nip region NP with respect to the nip plate 130. The stay 160 has a substantially U-shape configuration in conformity with the outer shape of the reflection portion 141 covering the reflection plate 140. For fabricating the stay 160, a highly rigid member such as a steel plate is folded into substantially U-shape.

The stay 160 has a pair of first frames 161 disposed in opposition to each other in the frontward/rearward direction, and a second frame 162 integrally connecting respective upper ends of the first frames 161. The stay 160 has a pair of ends in the leftward/rightward direction which are respectively held by guide members 170, shown in FIG. 4A. The nip plate 130 and the reflection plate 140 are also indirectly supported by the guide members 170 through the stay 160.

The guide members 170 are vertically movably supported to a groove 102 formed in the fixing frame 101, and has an arc-shaped inner periphery guide 171 to guide the inner peripheral surface 111 of the fusing belt 110 to a proper position. In addition, the fixing frame 101 is equipped with an arm member 181 as an urging member and a tension spring 182. The arm member 181 is pivotably supported to the fixing frame 101. The tension spring 182 urges downward an end portion of the arm member 181, which is on an opposite side from the pivotal center of the arm member 181.

The guide members 170 are configured so as to be urged downward (the urging direction) by the arm member 181 urged by the tension spring 182, and to thereby urge the nip plate 130, through the stay 160 and the reflection plate 140, toward the pressure roller 150.

In addition, as modifications, the halogen lamp 120 can be supported by the guide members 170 or by the fixing frame 101. Moreover, configurations are conceivable wherein the stay 160 and the nip plate 130 are fixed to the fixing frame 101, and the pressure roller 150 is urged toward the nip plate 130 by an urging member.

Next, details regarding the nip plate 130 will be described. As shown in FIG. 3, the nip plate 130 has a nip forming section 133 formed such that respective end portions thereof in the leftward/rightward direction are recessed upward, and a pair of supported members 134 formed so as to extend in a frontward/rearward direction from respective front and rear ends of the nip forming section 133.

The supported members 134 are formed into planar shapes perpendicular to the vertical direction, and are supported by the stay 160 through respective flanges 142 of the reflection plate 140.

The nip forming section 133 has a pair of end portions in the leftward/rightward direction at which are located recessed portions 133A and 133C, and has a central portion in the leftward/rightward direction at which is located a planar portion 133B. The recessed portions 133A and 133C are recessed upward, with an arcuate shape in cross-sectional view. The planar portion 133B is substantially perpendicular to the vertical direction. Further, as the recessed portions 133A and 133C extend from the ends of the nip forming section 133 in the leftward/rightward direction toward the planar portion 133B at the center of the nip forming section 133 in the leftward/rightward direction, the radius of curvature of the respective recessed portions 133A and 133C gradually increases such that the recessed portions 133A and 133C and the planar portion 133B are smoothly connected.

Figure 4A:
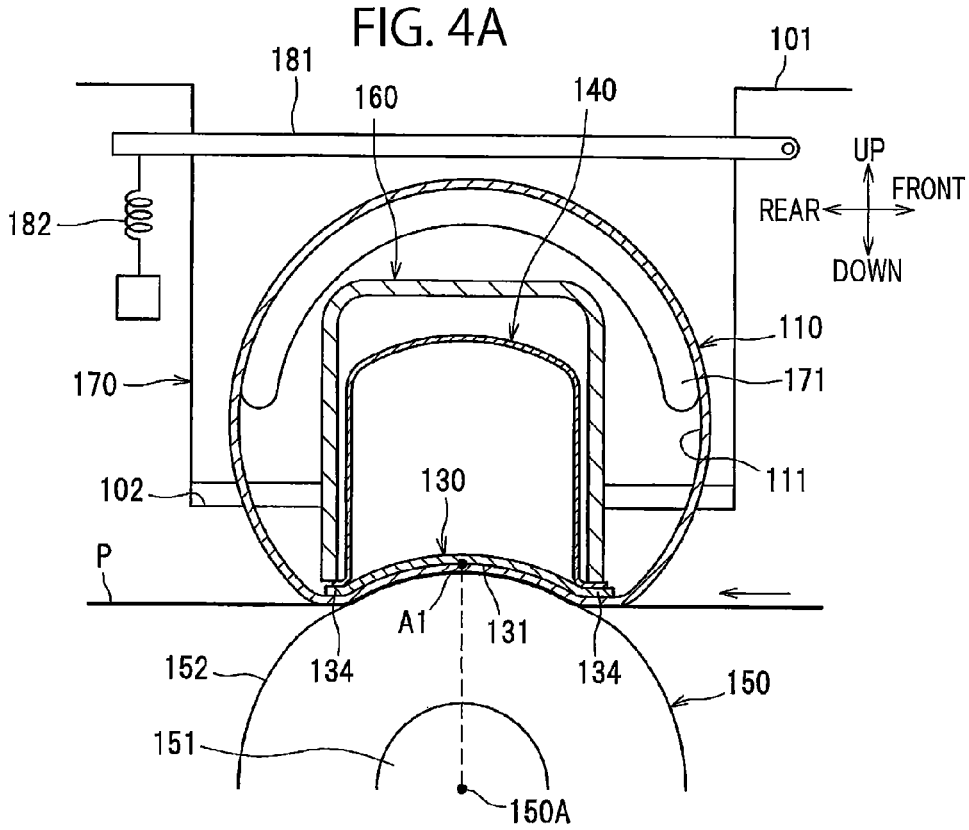
FIG. 4A is a cross sectional view showing a first end portion in a rightward/leftward direction of the fixing device.
Figure 4B:
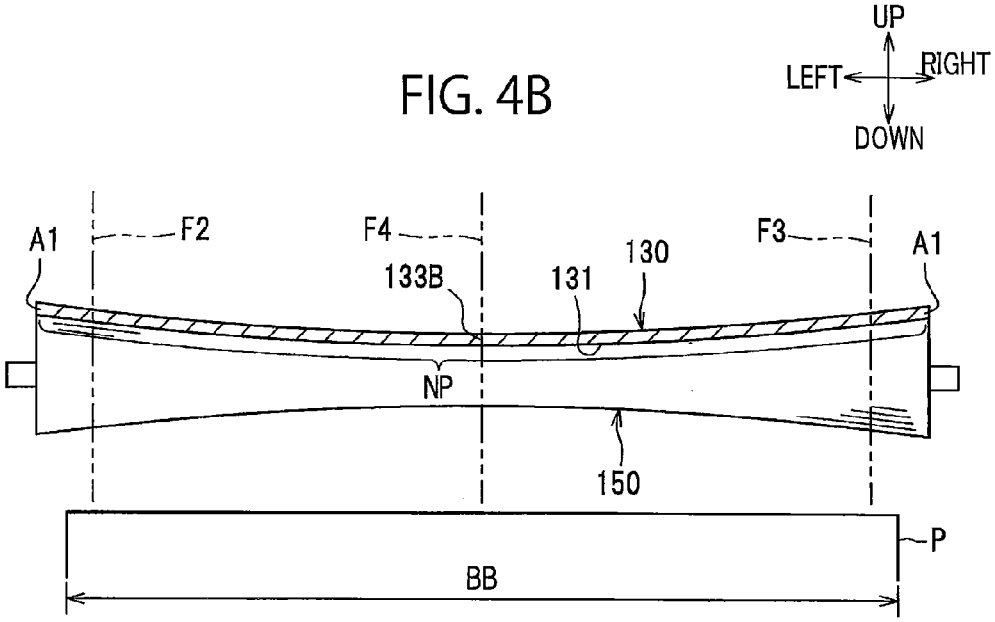
FIG. 4B is a cross sectional view showing relationship between the nip plate and the pressure roller.

When the nip plate 130, configured as described above, is cut by a first plane F1, shown in FIG. 3, a cross section of the lower surface 131 of the nip plate 130 has a convex shape protruding toward a pressure roller 150, as shown in FIG. 4B. In short, in the cross-section along the first plane F1, the lower surface 131 has a convex shape protruding toward the pressure roller 150. Here, first plane F1 refers to a plane that is perpendicular to the frontward/rearward direction (sliding contact direction) and contains the central area of the nip region NP in the frontward/rearward direction. Incidentally, members such as the fusing belt 110 have been omitted in FIG. 4B for the sake of convenience.

By thusly imparting the first plane F1 of the lower surface 131 with a cross-sectional shape along the first plane F1 which is a convex shape protruding in toward the pressure roller 150, the formation of wrinkles on the sheet P can be suppressed.

Meanwhile, when the nip plate 130 is cut by a second plane F2 or a third plane F3, shown in FIG. 3, a cross section of the lower surface 131 of the nip plate 130 has a concave shape recessing away from the pressure roller 150, as shown in FIG. 4A. In short, in the cross-section along the first planes F2 and F3, the lower surface 131 has a concave shape recessing away from the pressure roller 150.

Here, second plane F2 refers to a plane that is perpendicular to the axial direction of the pressure roller 150 and contains a first end region of the nip region NP in the axial direction, and third plane F3 refers to a plane that is perpendicular to the axial direction of the pressure roller 150 and contains a second end region of the nip region NP in the axial direction.

By thusly imparting the lower surface 131 of the nip plate 130 with a cross-sectional shape along the second plane F2 and the third plane F3 which is a concave shape recessing away from the pressure roller 150, a contact surface area between end portions of the fusing belt 110 and respective end portions of the pressure roller 150 can be increased without increasing nip pressure. For this reason, the width of the end portions of the nip region NP can be increased, and load placed on the motor in order to rotate the pressure roller 150 can be moderated.

Meanwhile, as shown in FIG. 4B, a cross section of the lower surface 131 of the nip plate 130 along the first plane F1 has a convex shape within the sheet width BB in the leftward/rightward direction. In addition, the second plane F2 and the third plane F3 constitute planes which are located within the sheet width BB in the leftward/rightward direction. In other words, the fixing device 100 is configured to convey the sheet P within a conveyance region having a prescribed width (which is the same as the sheet width BB shown) in the leftward/rightward direction, and into the nip region NP. Here, the conveyance region is a region where the nip region NP overlaps with the sheet P in the vertical direction.

Here, sheet width BB refers to any of multiple widths of sheets P which can be specified by the laser printer 1. Incidentally, the sheet width BB for determining the convex shape and the positions of the planes F2 and F3 can for example be 176 mm to conform to B5 size, 215.9 mm to conform to letter and legal size, or 210 mm to conform to A4 size, of the International Organization for Standardization (ISO). Additionally, the sheet width BB may be 100 mm to conform to postal card size.

By thusly imparting the lower surface 131 with the cross-sectional shape along the first plane F1 which is a convex shape within the sheet width BB in the leftward/rightward direction, the formation of wrinkles can be effectively suppressed. Furthermore, a concave shape is formed at each end portions in the cross sectional view along the plane F2 or F3, which is positioned within the sheet width BB. Accordingly, the nip region NP within the width BB can increase the area for nipping the sheet P. Therefore, the fixing operation with this configuration can maintain higher quality.

Specifically, the planes F2 and F3 can be positioned within an area which is at least 50 mm and at most 107 mm from a fourth plane F4 which contains a conveyance center line for the sheet P and is perpendicular to the leftward/rightward direction. Here, conveyance center line refers to a line that constitutes a conveyance reference when various types of sheets P with different sheet widths are conveyed without changing the position of the central portion in the leftward/rightward direction.

In addition, within the sheet width BB in the leftward/rightward direction, the lower surface 131 of the nip plate 130 is symmetric relative to the fourth plane F4.

Here, symmetric means both completely symmetric about the fourth plane F4 as well as substantially symmetric about the fourth plane F4 (with the respective sides of the fourth plane F4 having slightly different shapes). Specifically, symmetric here refers to a relationship wherein, in a cross section on any arbitrary plane perpendicular to the conveyance direction of the sheet P, a difference between a vertical coordinate of the lower surface 131 at a position 107 mm rightward of the fourth plane F4 and a vertical coordinate of the lower surface 131 at a position 107 mm leftward of the fourth plane F4 does not exceed 5 mm.

In this way, in comparison to configurations wherein for instance the lower surface of the nip plate is not symmetric relative to the fourth plane, the shape of the sheet P nipped in the nip region NP can be made symmetric relative to the conveyance center line, and the sheet P can thereby be conveyed straight along the conveyance center line.

In addition, the above-described convex and concave shapes of the nip plate 130 are formed using press working. In this press working process, work hardening can be performed on the end portions of the nip plate 130, and thus the yield strength of the end portions of the nip plate 130 is increased, and the end portions of the nip plate 130 can satisfactorily contact with the pressure roller 150.

FIG. 4A indicates a point A1 of the concave shape formed by the lower surface 131, which is the furthest point in the vertical direction from the central axis 150A in the cross sectional view along the plane F2 or F3. The point A1 overlaps with the shaft 151 when viewed from the vertical direction. As a result, the end portions of the pressure roller 150 can satisfactorily contact with the respective concave shapes of the lower surface 131.

In addition, in the present embodiment, the above-described point A1 overlaps with the central axis 150A when viewed from the vertical direction. As a result, in comparison to configurations wherein the point A1 is displaced from the central axis 150A, the end portions of the pressure roller 150 can satisfactorily contact with the respective concave areas of the lower surface 131 of the nip plate 130.

Incidentally, the depth of the respective concave shapes of the nip plate 130, i.e. the distance from the lower surface of the above-described point A1 to the lower surface of the supported members 134 in the vertical direction, can be ranging from 0.05 to 0.9 m, or 0.06 to 0.8 mm, or from 0.07 to 0.8 mm. Furthermore, the height of the convex shape of the lower surface 131, i.e. the distance from the lower surface of the above-described point A1 to the lower surface of the planar portion 133B in the vertical direction, can also be ranging from 0.05 mm to 0.9 mm, or 0.06 mm to 0.8 mm, or from 0.07 mm to 0.8 mm.

Incidentally, the present invention is not limited to the above-described embodiment, and can be utilized according to a variety of modifications, as will be described below. In the descriptions below, members having a structure substantially identical to that in this embodiment are assigned by the same numerals and characters as those shown in this embodiment.

Figure 5:
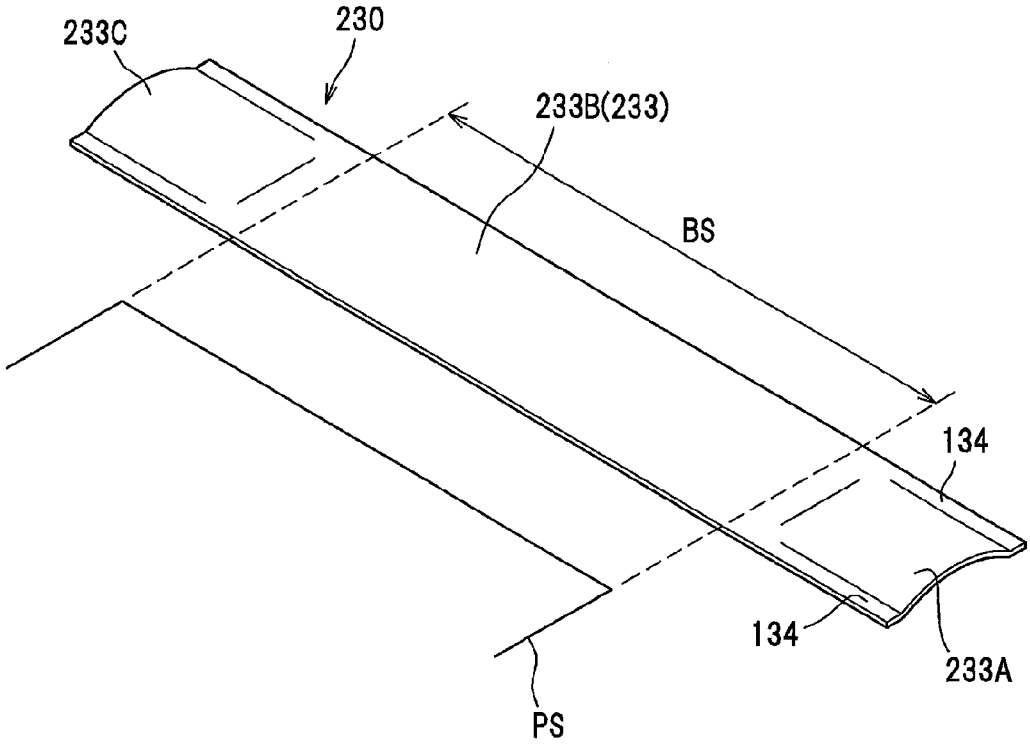
FIG. 5 is a perspective view showing a nip plate according to a first modification.

In the aforementioned embodiment, the nip forming section 133 of the nip plate 130 is formed such that the recessed portions 133A and 133C and the planar portion 133B are smoothly connected. However, the present invention is not limited to this configuration. For example, the nip forming section 233 of the nip plate 230 can also be formed into a stepped shape, as shown in FIG. 5. Specifically, the nip forming section 233 has a pair of end portions in the leftward/rightward direction at which are located recessed portions 233A and 233C, and has a central portion in the leftward/rightward direction at which is located a planar portion 233B.

The recessed portions 233A and 233C are recessed upward, with an arcuate shape in cross-sectional view. The planar portion 233B is substantially perpendicular to the vertical direction.

The recessed portions 233A and 233C have a fixed width in the leftward/rightward direction, and are formed with a constant radius of curvature from one end to an opposite end in the leftward/rightward direction. The planar portion 233B is formed to be longer in the leftward/rightward direction than a minimum sheet width BS, and is formed so as to extend in the leftward/rightward direction beyond the respective left and right edges of the sheet P. Here, minimum sheet width BS refers to the width of a minimum size PS having the smallest sheet P width which can be specified with the laser printer 1, in other words the minimum sheet width which can be set using a width guide on the sheet supply tray 31. For example, the minimum sheet width BS can be set to the width of postcards (100 mm).

In this way, by forming the planner portion 233B to extend in the leftward/rightward direction to outside the respective left and right edges of the minimum size sheet PS, the minimum size sheet PS can be conveyed on a straight path in the frontward/rearward direction in comparison to configurations wherein for instance the nip plate is formed into an uneven shape within the minimum sheet width.

Figure 6A:
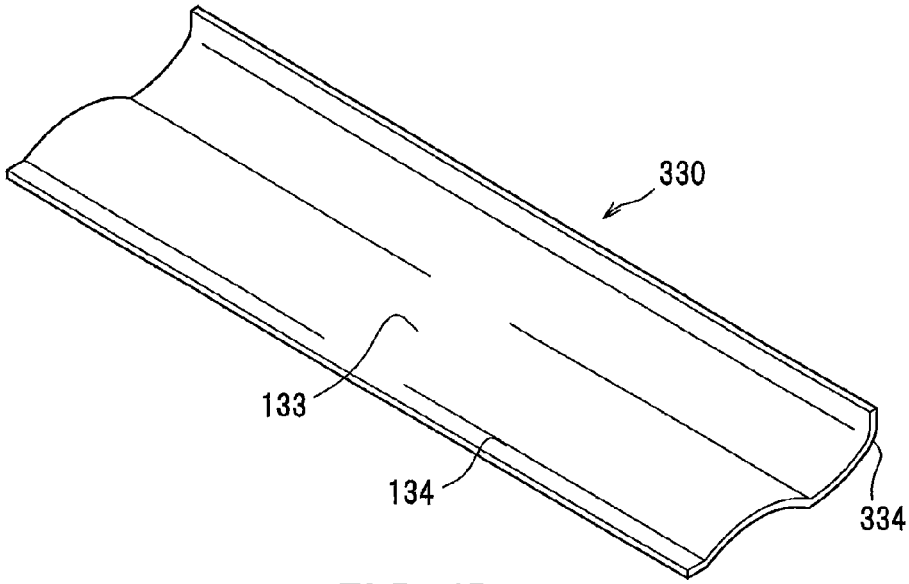
FIG. 6A is a perspective view showing a nip plate according to a second modification.
Figure 6B:
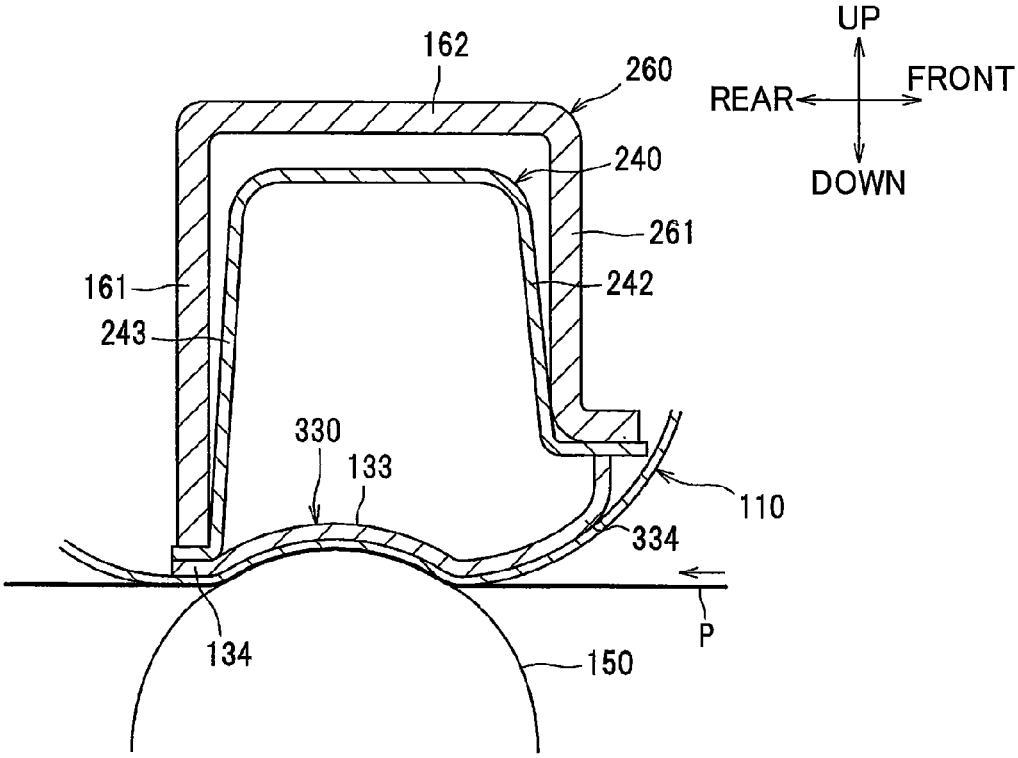
FIG. 6B a cross sectional view showing the nip plate according to the second modification.

Moreover, the shape of the nip plate is not limited to that in the aforementioned embodiment and in FIG. 5. For example, as shown in FIG. 6(*a*), a nip plate 330 can be configured to have the nip forming section 133 and the rearward supported member 134 in the aforementioned embodiment, and also to have an arc-shaped supported portion 334 bending upward from the front edge of the nip forming section 133. In addition, when employing such a nip plate 330, a lower edge face of a first frame 261 at the front side of a stay 260 can be offset farther upward than a lower edge face of the first frame 161 at the rear side of the stay 260, and the lower edge face of a front wall 242 of a reflection plate 240 can be offset farther upward than the lower edge face of a rear wall 243 of the reflection plate 240.

In this embodiment as well, the left and right end portions of the nip forming section 133 are formed into a concave shape, so the same effects as with the aforementioned embodiment can be achieved.

The aforementioned embodiment was configured such that the stay 260 supports the nip plate 130 indirectly through the reflection plate 140. However, the present invention is not limited to this configuration. The stay can alternatively support the nip plate directly.

With the pressure roller 150 shown as an example of a rotating body in the aforementioned embodiment, the diameter of the end portions 152A and 152C is larger than the diameter of the central portion 152B. However, the present invention is not limited to this configuration. The pressure roller can be configured such that, at least during fixing operation, the diameter of the end portions is larger than the diameter of the central portion.

For example, the pressure roller can be configured to have a shaft, an elastic layer coating the shaft, and a tube coating the elastic layer, and to have wrinkles on the respective end portions of the tube in the axial direction. In this case, when fixing operation is not being performed, the respective end portions and the central portion of the pressure roller have substantially the same diameter. However, when fixing operation is being performed, i.e. when heat is applied to the pressure roller, the pressure roller expands to unwrinkle, and the respective diameters of the end portions of the pressure roller become larger than the diameter of the central portion.

In addition, for example, the pressure roller can be configured to have a shaft and an elastic layer coating the shaft, wherein the diameter of the respective end portions of the shaft is smaller than the diameter of the central portion, and the diameter of the elastic layer is constant. In this case as well, when fixing operation is not being performed, the respective end portions and the central portion of the pressure roller have substantially the same diameter. However, due to the fact that the elastic layer becomes thicker at the respective end portions and thinner at the central portion, when fixing operation is being performed, i.e. when heat is applied to the pressure roller, the end portions of the elastic layer expand more than does the central portion, and the respective diameters of the end portions of the pressure roller become larger than the diameter of the central portion.

In the aforementioned embodiment, sheets P such as normal paper and postcards were given as examples of recording sheets. However, the present invention is not limited to these example. The sheets can also be, for example, overhead projector sheets.

In the aforementioned embodiment, the present invention was employed in the laser printer 1. However, the present invention is not limited to this configuration. For example, the present invention can also be employed in other image forming devices such as copying machines and multi-function printers.

In the aforementioned embodiment, the pressure roller 150 was shown as an example of a rotating body. However, the present invention is not limited to this configuration. For example, the rotating body can alternatively be a belt-shaped rotating body. Incidentally, in this case, the axial direction of one of multiple rollers supporting the belt will be the axial direction of the rotating body.

In the aforementioned embodiment, the left and right ends of the nip plate 130 are each formed into a concave shape. However, the present invention is not limited to this configuration. The nip plate 130 can alternatively be configured such that only one side of the nip member is formed into a concave shape.

In the aforementioned embodiment, the nip plate 130 was shown as an example of a nip member. However, the present invention is not limited to this configuration. For example, a thick pad-shaped or block-shaped nip member can alternatively be used.

In the aforementioned embodiment, the first surface (the lower surface 131) is formed so as to run parallel to the second surface (the upper surface 132). However, the present invention is not limited to this configuration. The first surface can be formed into a shape which is different from that of the second surface, and which does not run parallel to the second surface.

In the aforementioned embodiment, the halogen lamp 120 was shown as an example of a heater. However, the present invention is not limited to this configuration. For example, a carbon heater or an IH (induction heating) heater can be used. Here, IH heater refers to a heater which generates heat in the nip member itself by generating an eddy current in the nip member to be heated.

In the aforementioned embodiment, the rubber layer 152 was shown as an example of an elastic layer. However, the present invention is not limited to this configuration. Elastic layers made from materials other than rubber can be used.

In the aforementioned embodiment, the arm member 181 is shown being urged by the tension spring 182 as an example of an urging member. However, the present invention is not limited to this configuration. For example, a compression spring which directly urges the guide member can alternatively be used.

What is claimed is:

1. A fixing device comprising:

a nip member having a first surface and a second surface opposite to the first surface;

an endless belt having an inner peripheral surface and an outer peripheral surface, the inner peripheral surface being configured to be in sliding contact with the first surface in a sliding direction;

a supporting member having an upstream supporting surface configured to support the nip member, and a downstream supporting surface configured to support the nip member, the downstream supporting surface being disposed downstream of the upstream supporting surface in the sliding direction; and a rotating body configured to rotate and nip the endless belt in cooperation with the nip member, and configured to constitute a nip region between the endless belt and the rotating body, the rotating body having an axis defining an axial direction, the nip region defining a first imaginary plane, a second imaginary plane, and a third imaginary plane, the first imaginary plane being perpendicular to the sliding direction and containing a center of the nip region in the sliding direction, the second imaginary plane being perpendicular to the axial direction and containing a first end portion of the nip region in the axial direction, the third imaginary plane being perpendicular to the axial direction and containing a second end portion of the nip region opposite to the first end portion in the axial direction, the first surface being a convex shape protruding toward the rotating body in a first cross-section taken along the first imaginary plane, and being concave shape concaved in a direction opposite to the rotating body in a second cross-section and a third cross-section taken along the second imaginary plane and the third imaginary plane, the first surface having at least a portion forming the convex shape and the concave shape, and the portion being positioned between the upstream supporting surface and the downstream supporting surface in the sliding direction.

2. The fixing device according to claim 1, wherein the convex shape of the first surface in the first cross-section is provided within a width of a recording sheet; and wherein the second imaginary plane and the third imaginary plane are positioned within the width of the recording sheet.

3. The fixing device according to claim 1, wherein the nip region further defines a fourth imaginary plane perpendicular to the axial direction and including a conveyance center line of a recording sheet; and wherein the second imaginary plane and the third imaginary plane are positioned away from the fourth imaginary plane by a length ranging from 50 mm to 107 mm in the axial direction.

4. The fixing device according to claim 1, wherein the nip region further defines a fourth imaginary plane perpendicular to the axial direction and including a conveyance center line of a recording sheet; and wherein the first surface is symmetrical with respect to the fourth imaginary plane within a width of the recording sheet.

5. The fixing device according to claim 2, wherein the width of the recording sheet is 176.0 mm.

6. The fixing device according to claim 2, wherein the width of the recording sheet is 215.9 mm.

7. The fixing device according to claim 2, wherein the width of the recording sheet is 210.0 mm.

8. The fixing device according to claim 1, wherein the nip member comprises a metal plate, the second surface of the nip member being in conformance with the first surface.

9. The fixing device according to claim 8, wherein the convex shape and the concave shape are formed by press working.

10. The fixing device according to claim 1, further comprising a heater that faces the second surface of the nip member and is spaced away from the second surface of the nip member.

11. The fixing device according to claim 1, wherein the rotating body is a roller comprising a shaft and an elastic layer formed over the shaft, the roller defining a center axis; and the fixing device further comprising an urging member that urges the nip member toward the roller in a urging direction;

wherein the concave shape in the second cross-section has a first furthest part furthest from the center axis and aligned with the shaft in the urging direction; and wherein the concave shape in the third cross-section has a second furthest part furthest from the center axis and aligned with the shaft in the urging direction.

12. The fixing device according to claim 11, wherein the first furthest part is aligned with the center axis in the urging direction; and wherein the second furthest part is aligned with the center axis in the urging direction.

13. The fixing device according to claim 1, wherein the rotating body is a roller having a first end section, a second end section, and a center section between the first end section and the second end section in the axial direction, the first end section and the second end section being configured to have diameters larger than that of the center section at least during fixing operation.

14. The fixing device according to claim 13, wherein the first end section and the second end section have diameters larger than that of the center section.

15. A fixing device comprising:

a nip member having a first surface and a second surface opposite to the first surface;

an endless belt having an inner peripheral surface and an outer peripheral surface, the inner peripheral surface being configured to be in sliding contact with the first surface in a sliding direction;

a supporting member having an upstream supporting surface configured to support the nip member, and a downstream supporting surface configured to support the nip member, the downstream supporting surface being disposed downstream of the upstream supporting surface in the sliding direction; and a rotating body configured to nip the endless belt in cooperation with the nip member, and configured to constitute a nip region between the endless belt and the rotating body, the rotating body having an axis defining an axial direction, the nip region defining a first imaginary plane and a second imaginary plane, the first imaginary plane being perpendicular to the sliding direction and containing a center of the nip region in the sliding direction, the second imaginary plane being perpendicular to the axial direction and containing a first end portion of the nip region in the axial direction, the first surface being a convex shape protruding toward the rotating body in a first cross-section taken along the first imaginary plane, and being concave shape concaved in a direction opposite to the rotating body in a second cross-section taken along the second imaginary plan, the first surface having at least a portion forming the convex shape and the concave shape, and the portion being positioned between the upstream supporting surface and the downstream supporting surface in the sliding direction.

16. The fixing device according to claim 15, wherein the convex shape of the first surface in the first cross-section is provided within a width of a recording sheet.

17. The fixing device according to claim 15, wherein a distance between the second imaginary plane and a fourth imaginary plane is from 50 mm to 107 mm, the fourth imaginary plane being perpendicular to the axial direction and passing through a conveyance center line of a recording sheet.

18. The fixing device according to claim 15, wherein the first surface is symmetrical with respect to a fourth imaginary plane within a width of a recording sheet, the fourth imaginary plane being perpendicular to the axial direction and passing through a conveyance center line of a recording sheet, the fourth imaginary plane being perpendicular to the axial direction and passing through the conveyance center line of a recording sheet.

19. The fixing device according to claim 16, wherein the width of the recording sheet is 176.0 mm.

20. The fixing device according to claim 16, wherein the width of the recording sheet is 210.0 mm.

21. The fixing device according to claim 1, wherein the second surface is convexed toward the rotating body in the first cross-section, and is concaved away from the rotating body in the second cross-section and in the third cross-section.

22. The fixing device according to claim 21, wherein the nip member is made from metal.

23. The fixing device according to claim 15, wherein the second surface is convexed toward the rotating body in the first cross-section, and is concaved away from the rotating body in the second cross-section.

24. The fixing device according to claim 23, wherein the nip member is made from metal.

25. The fixing device according to claim 1, further comprising a heater, the nip member being disposed between the heater and the rotating body.

26. The fixing device according to claim 1, further comprising a reflection plate opposite to the rotating body with respect to the nip member, the reflection plate being configured to reflect radiant heat.

27. The fixing device according to claim 1, further comprising a heater configured to emit radiant heat, the nip member being heated by the radiant heat emitted from the heater.

* * * * *